US006454307B1

(12) United States Patent
Polick

(10) Patent No.: US 6,454,307 B1
(45) Date of Patent: Sep. 24, 2002

(54) READING DEVICE WITH A MOVABLE BINDING WHICH ALTERNATELY ALLOWS ACCESS TO ONE OR TWO SETS OF PAGES

(75) Inventor: Peter Polick, New York, NY (US)

(73) Assignee: Innovative USA, Inc., Norwalk, CT (US)

( * ) Notice: Subject to any disclaimer, the term of this patent is extended or adjusted under 35 U.S.C. 154(b) by 0 days.

(21) Appl. No.: 09/879,301

(22) Filed: Jun. 12, 2001

(51) Int. Cl.[7] ..... B42D 17/00

(52) U.S. Cl. ..... 281/45; 281/2; 281/3.1; 281/38; 281/21.1; 283/34; 283/63.1

(58) Field of Search ..... 283/34, 35, 61, 283/62, 65, 115, 63.1; 281/2, 3.1, 15.1, 21.1, 38, 45, 46; 402/4

(56) References Cited

U.S. PATENT DOCUMENTS 4,360,346 A * 11/1982 Ehsanipour ..... 283/34
5,110,232 A 5/1992 Jermann
5,160,170 A * 11/1992 Ferra ..... 283/34
5,193,962 A 3/1993 Parker
5,330,229 A 7/1994 Zoltner
5,358,761 A * 10/1994 McDonald ..... 283/34
5,626,365 A 5/1997 Petteway
5,685,569 A 11/1997 Chou
5,725,252 A * 3/1998 Crum et al. ..... 283/34
5,735,659 A 4/1998 Kosasa
5,799,980 A 9/1998 McAdam

* cited by examiner

*Primary Examiner*—William Fridie, Jr.
(74) *Attorney, Agent, or Firm*—Hedman & Costigan, P.C.

(57) ABSTRACT

An accordion-folded page book with a binding which compresses the pages of the book but is not permanently fastened in one location, thereby allowing the binding to be moved from one position which allows access to one set of pages, to a second position which allows access to a second set of pages; whereby sliding the binding and flipping the book over enables the user to have access to the opposite sides of the pages.

21 Claims, 12 Drawing Sheets

FIG. 1C
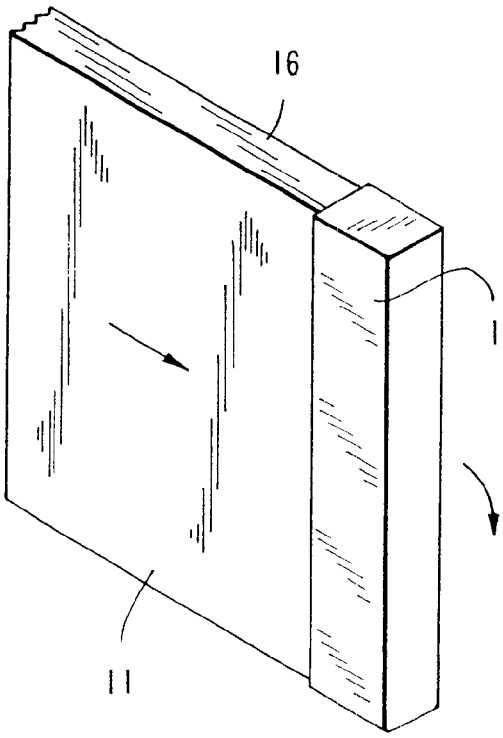
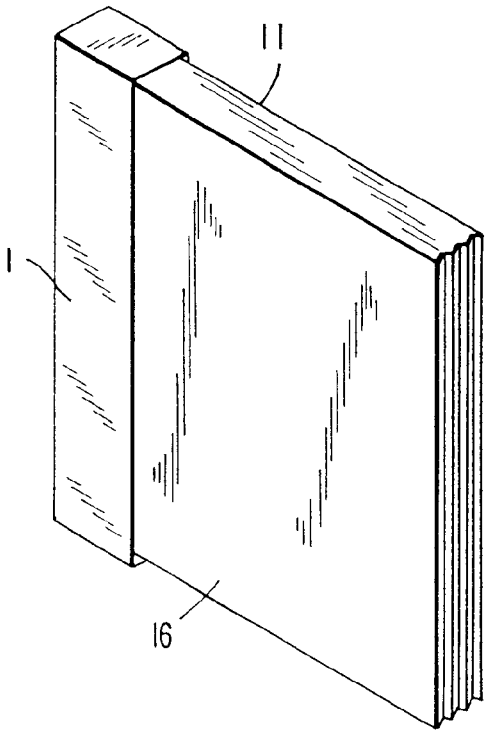
FIG. 1D

FIG. 3A
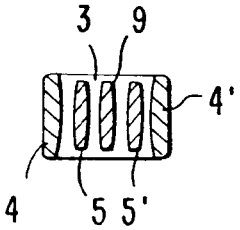
FIG. 3D
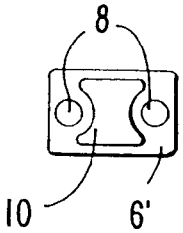
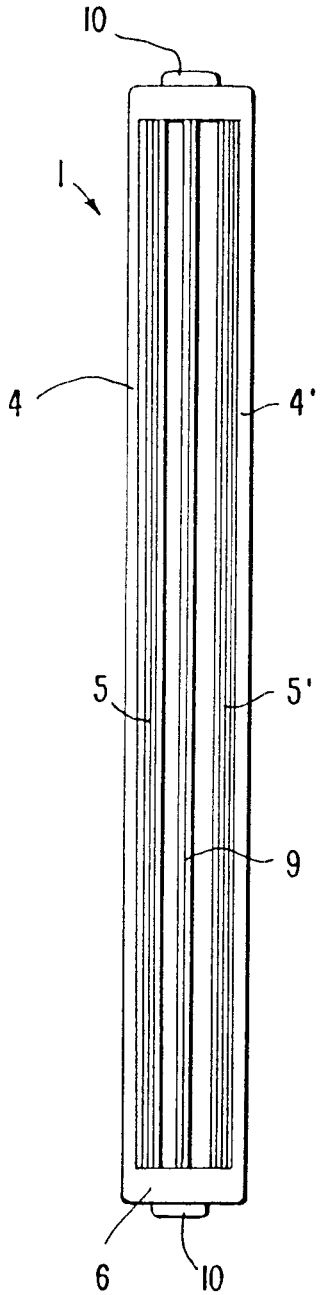
FIG. 3B
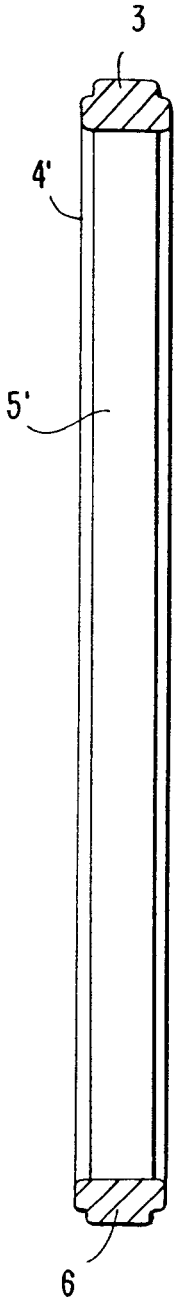
FIG. 3C

READING DEVICE WITH A MOVABLE BINDING WHICH ALTERNATELY ALLOWS ACCESS TO ONE OR TWO SETS OF PAGES

FIELD OF THE INVENTION

The present invention relates to a reading device, such as a book, with a movable binding.

BACKGROUND OF THE INVENTION

The book market includes those written specifically for particular groups. In addition, the market includes books that are specifically designed in size and shape to capture the attention of the reader and/or help illustrate the material presented.

The most relevant prior art includes bound volumes which recite questions/riddles on one page and then recite the answers/solutions on pages which either immediately follow the page containing the question/riddle or have the answers/solutions grouped in the last section of bound pages of the volume. In addition, books bound in the traditional manner routinely contain different types of material divided into sections or chapters.

The prior art also includes U.S. Pat. No. 5,626,365 for "TWO-WAY BOOK". This book is designed to facilitate reading to young children. The book has a spiral-type, fixed location, binding and contains duplicate successive pages, i.e., page one and page two each have the same design and/or wording, page 3 and page 4 have the same design and/or wording, etc. This page arrangement and the spiral-type binding allow the reader to open the book and look at page one while presenting page two to the "audience", providing both the reader and "audience" with the same view of the design and/or wording However, the prior art does not include a book that provides two books in one. The present inventor has developed an accordion-folded page book with a movable binding which allows access in the alterative to one of two sets of pages. Thus, the book serves as a conduit for two different sets of information in the form of one bound volume.

Additionally, this book facilitates the conveyance of material by presenting two separate sets of material in one bound volume. The types of material may include complementary material, for example, the alphabet (book 1*a*) and words beginning with each letter of the alphabet (book 1*b*); material of independent interest, for example, the alphabet (book 1*a*) and numbers (book 1*b*); or dependent materials, for example, questions/problems/brainteasers (book 1*a*) and the answers to said questions/problems/brainteasers (book 1*b*).

SUMMARY OF THE INVENTION

It is an object of the present invention to provide a book which has two sets of pages bound with a movable binding which allows for access to one set of pages to the exclusion of the other set of pages.

Accordingly, the book of the present invention is comprised of a set of accordion-folded pages with a binding that secures the pages of the book but is not permanently fastened in one location. Instead the binding may slide from one end of the accordion pages to the other end of the accordion pages thus enabling the book to be opened at either end. The binding may also provide the location for mounting a reversible by flipping front cover and a reversible by flipping back cover.

BRIEF DESCRIPTION OF THE DRAWINGS

FIGS. 1A, 1B, 1C and 1D depict an embodiment of the present invention.

FIGS. 3A, 3B, 3C, and 3D depict an embodiment of a book binding in accordance with the present invention.

DETAILED DESCRIPTION OF THE PRESENT INVENTION AND DESCRIPTION OF THE PREFERRED EMBODIMENTS

Figure 1A:
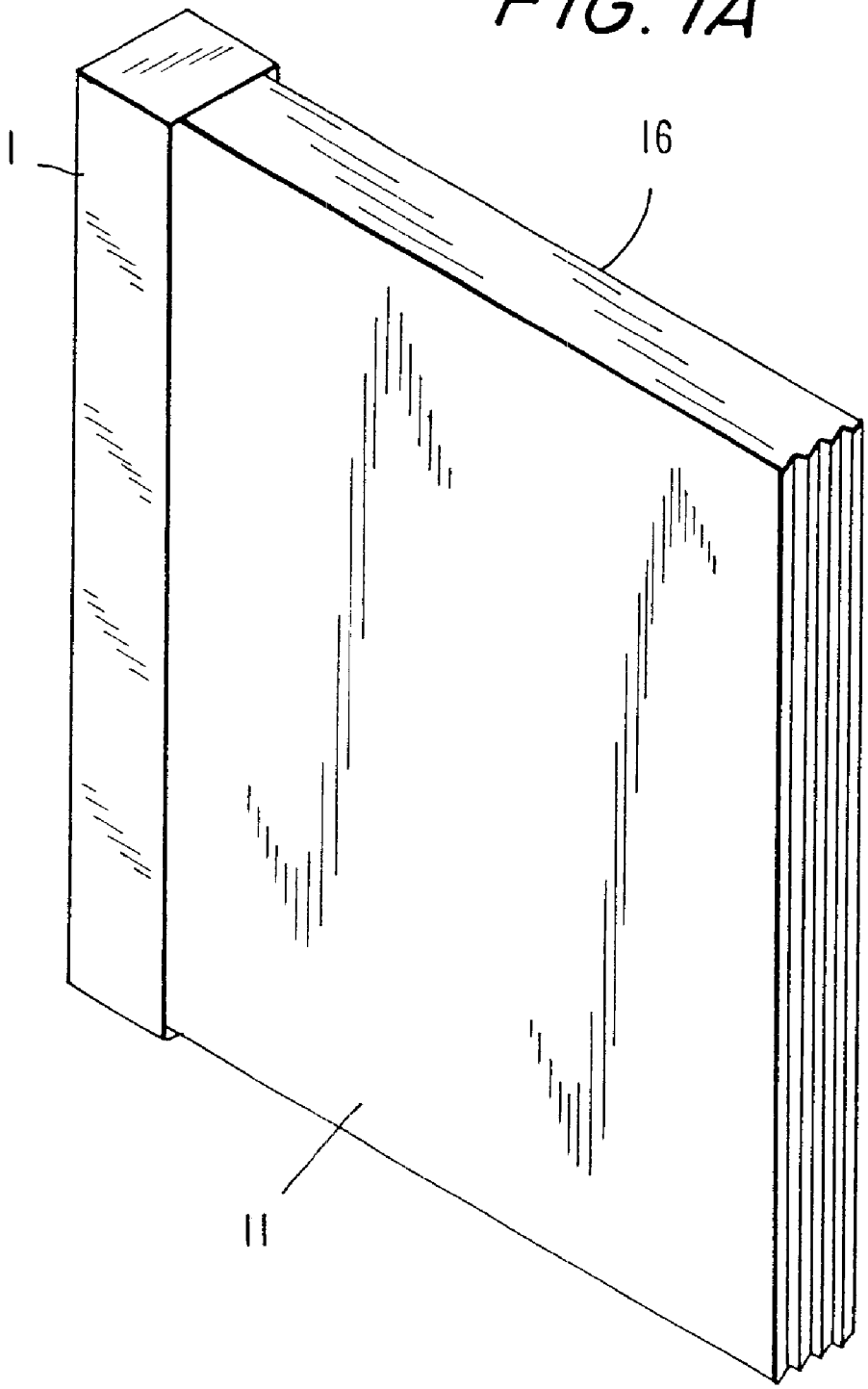

Referring to FIGS. 1A, 1B, 1C, and 1D, there is shown front views and a top-side view of a book of the present invention which comprises a set of accordion-folded pages 14 with a movable binding 1 which is slidably attached to at least two pockets (FIG. 6A) formed at least at each end of the accordion folded pages. The binding has an opening suitably adapted to securing the remaining accordion folded pages in order to form a non-permanent binding for the pages. The design of the present invention, allows for sliding the binding 1 from the left edge of the accordion folded pages (FIG. 1A) in which the reader has access to one side of the accordion folded pages of the book to the right edge of the accordion folded pages (FIG. 1C). The book may then be flipped "front" to "rear" so that the first page of the book 11 (see FIGS. 1A, 9B, 9C and 9D) becomes the last page of the book and the last page of the book 16 in FIG. 1D becomes the first page in FIG. 1D. Thus providing the reader access to the other side of the accordion folded pages of the book.

Figure 1B:
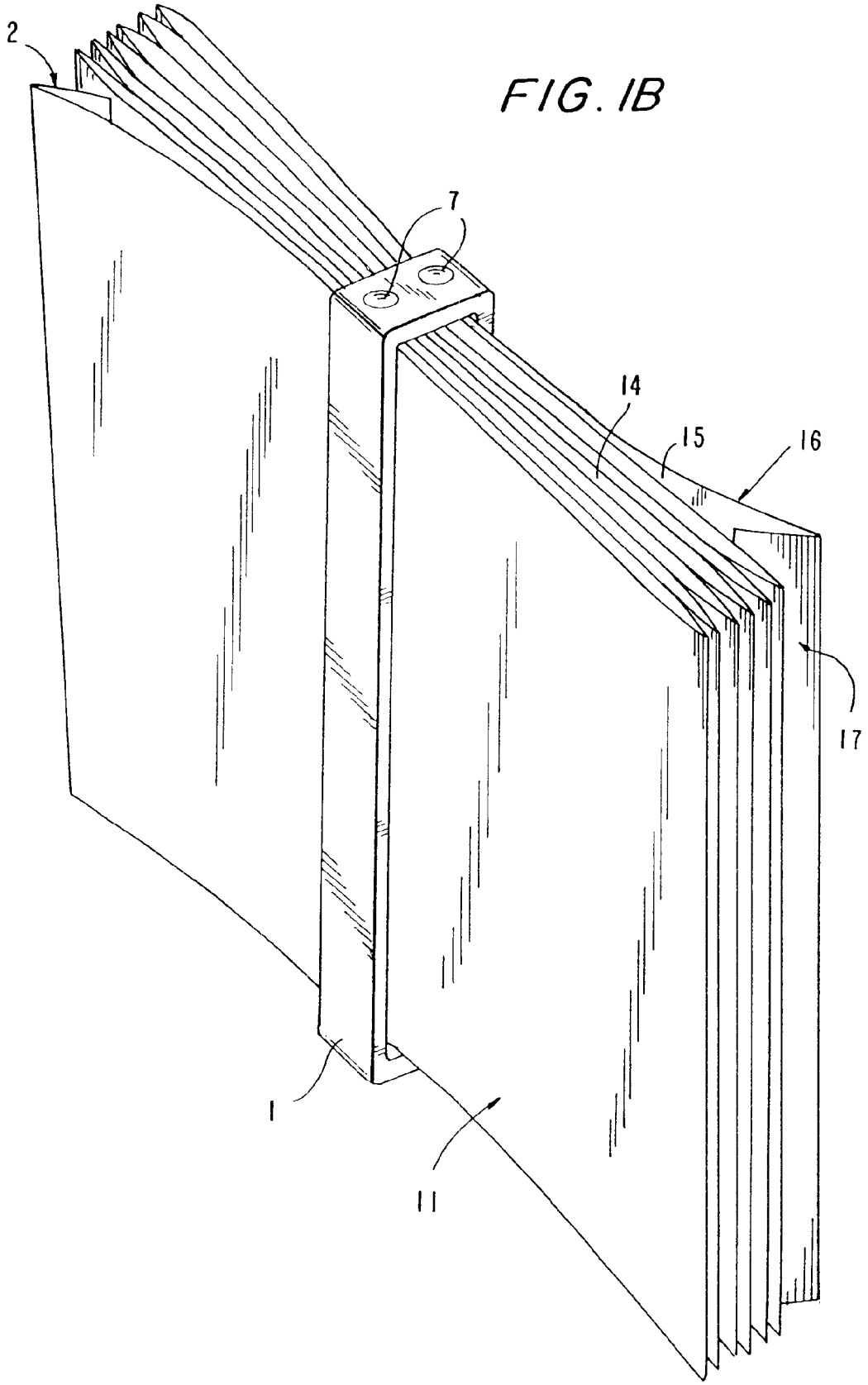

Referring to FIGS. 2A–2G, inclusive, there is disclosed a preferred movable binding for use in accordance with the present invention. The method of binding the accordion pages together allows for the pages to be secured firmly enough to hold the pages in place with the binding 1 positioned at the left edge (FIG. 1A) due to the added thickness from the folds, while still allowing the binding 1 to be slidably movable between the right edge and the left edge (FIG. 1B and FIG 1C). The binding 1 is comprised of at least four elongated sections, with two elongated sections 4 and 4' forming the sides of the frame and two or more 5 and 5' forming the interior sections, with three or four or more interior sections also being contemplated by the present invention. See FIGS. 3A–3D.

The elongated sections are constructed of a rigid material and set parallel to each other with at least two interior sections 5 and 5' and two exterior sections 4 and 4', The interior sections 5 and 5' are the points at which the pages will be secured to binding. The interior sections will be set at a distance in proportion to the thickness of the pages of the book so as to form the width necessary to encompass the pages of the book yet allow the binding to be moved to another location.

Figure 2A:
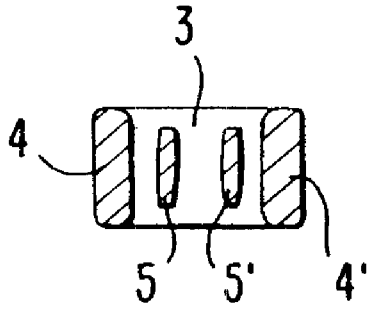
FIGS. 2A, 2B, 2C, 2D, 2E, 2F, and 2G depict an embodiment of a book binding in accordance with the present invention.
Figure 2B:
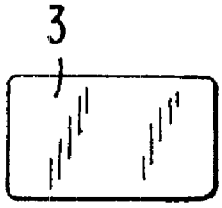

FIG. 2A shows the connection of the elongated sections to the bottom interior side of top connector 3. Top connector 3 is constructed of a rigid material capable of maintaining a set distance between each elongated section. FIG. 2B shows the top exterior side of top elongated section 3'.

Figure 2C:
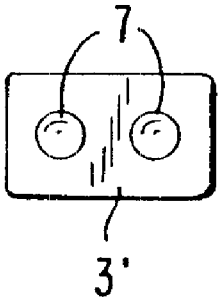

Optionally, as shown in FIG. 2C, the top exterior side of top connector 3' may include two round depressions 7 on the top exterior side capable of receiving a pair of shaped protrusion connectors 22 (see FIGS. 7A and 8B) for connecting to a front cover and a back cover.

Figure 2F:
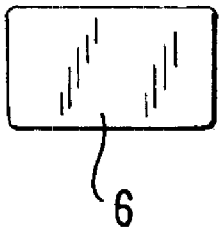
Figure 2G:
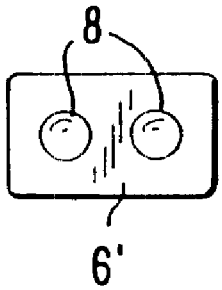
Figure 2D:
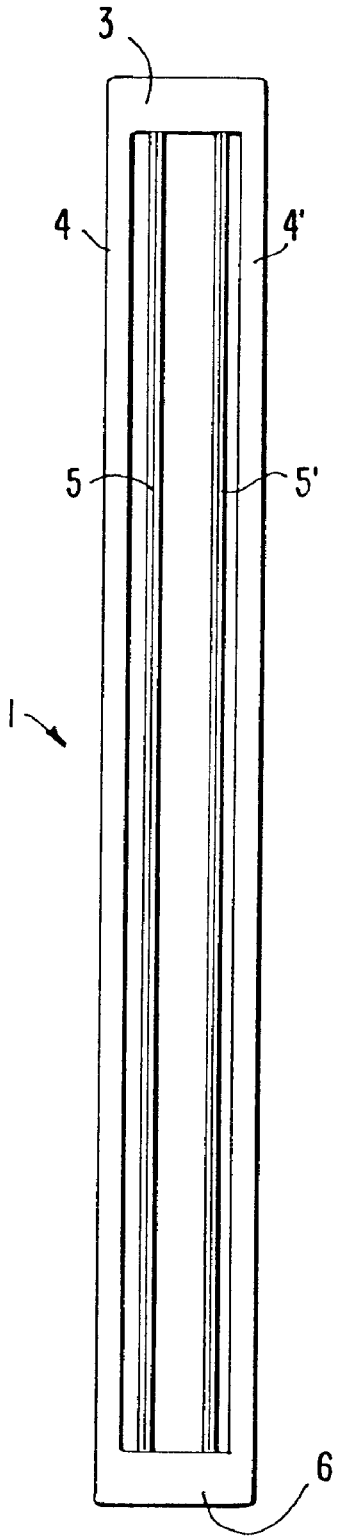
Figure 2E:
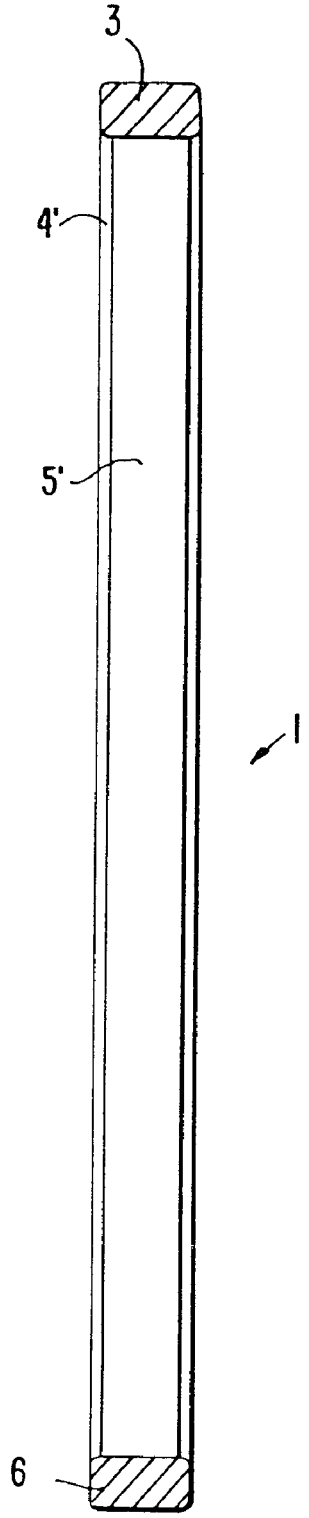

The elongated sections are connected at the bottom by bottom connector 6 (FIG. 2D) also constructed of a rigid material capable of maintaining a set distance between each elongated section. FIG. 2E shows a viewpoint of the longitudinal cross section of FIG. 2D taken along the vertical axis of the inside of FIG. 2D. FIG. 2F shows the bottom exterior side of bottom elongated section 6. Optionally, as shown in FIG. 2G the bottom exterior side of bottom connector 6' may include two round depressions 8 capable of receiving a pair of shaped protrusion connectors 22' (see FIGS. 7A and 8B) for connecting to a front cover and a back cover.

The binder described above may be constructed of separate elongated sections which are fitted together, such as by snap fitting, or, in the alternative, cast or molded as one piece with the above described elongated sections or a combination of cast or molded pieces with separate elongated sections which are fitted together.

Referring to FIGS. 3A–3D, inclusive, there is disclosed a preferred movable binding for use in accordance with the present invention. The method of binding the accordion pages together allows for the pages to be secured firmly enough to hold the pages in place with the binding 1 positioned at the left edge (FIG. 1A) while still allowing the binding 1 to be moved to the right edge (FIG. 1B and FIG. 1C) and back. The binding 1 of FIGS. 3A–3D is comprised of at least five elongated sections, with two elongated sections 4 and 4' forming the sides of the frame and at least three forming the interior sections, with three or four interior sections being preferred.

Referring to FIGS. 3A and 3B, the elongated sections are constructed of a rigid material and set parallel to each other with at least three interior sections 5, 5', and 9 and two exterior sections 4 and 4'. The interior sections 5 and 5' are the points at which each end of the accordion folded pages will be secured to binding. The interior section 9 is the point at which the midsection of the accordion folded pages will be secured to binding as described further hereinbelow. The interior sections will be set at a distance in proportion to the thickness of the pages of the book so as to form the width necessary to encompass the pages of the book yet allow the binding to be moved to another location. The elongated sections are connected at the top and bottom by top connector 3 (FIG. 3A) constructed of a rigid material capable of maintaining a set distance between each elongated section.

Optionally, as shown in FIG. 2C, the top exterior side of top connector 3' may include two round depressions 7 capable of receiving a shaped protrusion connectors 22 (See FIG. 7A and 8B) in a hinge like fashion to connect to front and back covers. The elongated sections are connected at the bottom by bottom connector 6' (FIG. 3D) also constructed of a rigid material capable of maintaining a set distance between each elongated section. Optionally, as shown in FIG. 3D, the bottom exterior side of bottom connector 6' may include two round depressions 8 capable of receiving a pair of shaped protrusion connectors 22' (see FIGS. 7A and 8B) in a hinge like fashion to connect to the front and back covers.

The binder described above may be constructed of separate elongated sections which are fitted together, such as by snap fitting, or, in the alternative, cast or molded as one piece with the above described elongated sections or a combination of cast or molded pieces with separate elongated sections which are fitted together.

FIGS. 3B & 3D also discloses an optional hinge stop 10 which will permit the optional hinged covers to open to the desired 180 degrees, but prevent further than 180 degree rotation of the hinged covers. Likewise a hinge stop may also be added or molded on top connector 3'.

Figure 4:
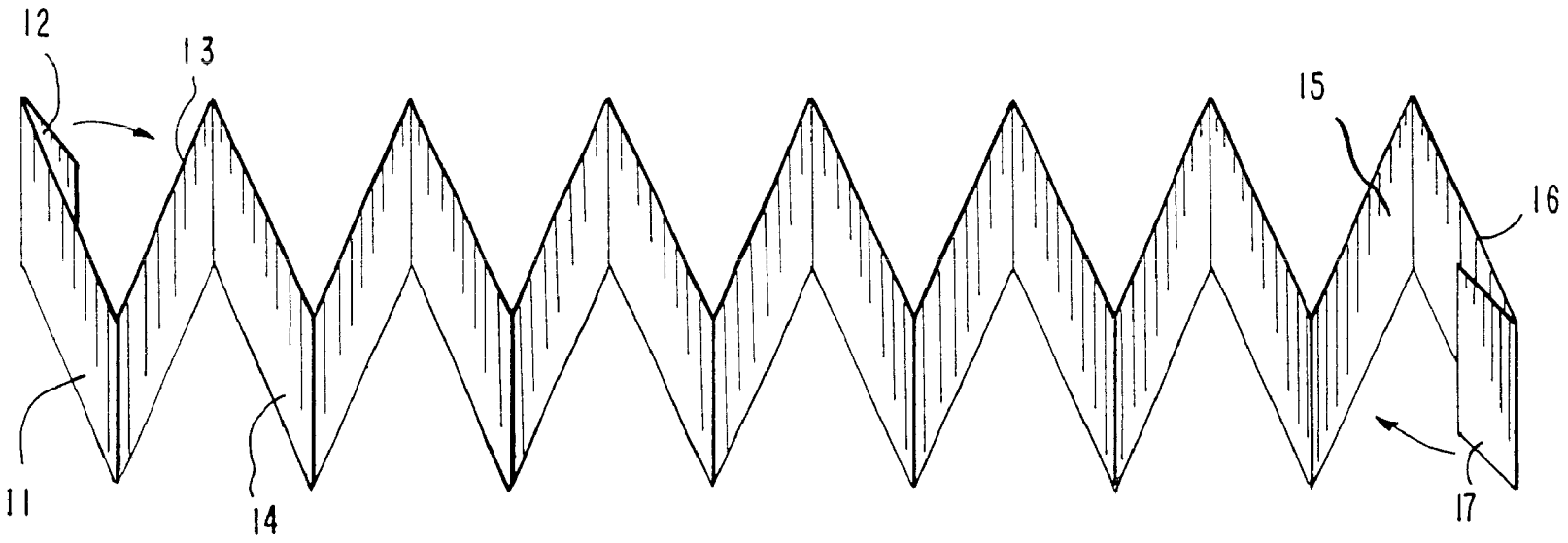
FIG. 4 depicts an embodiment of accordion folded pages in accordance with the present invention.

Referring to FIG. 4, there is shown accordion-folded pages 14 which may contain a plurality of graphics and/or text comprising two separate recitations of material. The material used to create the pages is folded in an "accordion" fashion. The pages of the book are made up of one or more sheets of material joined end to end. The folding of the pages may preferably allow each end page 11 and 16 to be longer than each of the interior pages 14. The end page should be longer in an amount sufficient to form tabs 12 and 17, preferably from 5% to 35% longer than the inside pages 14. This extra section is folded back to form a tab 12 at one end of the page material and a tab 17 at the opposite end of the page material. Tabs 12 and 17 are suitable for accepting an adhesive or other binding substance for attachment to surfaces 13 and 15, respectively, as discussed more fully below.

Figure 5:
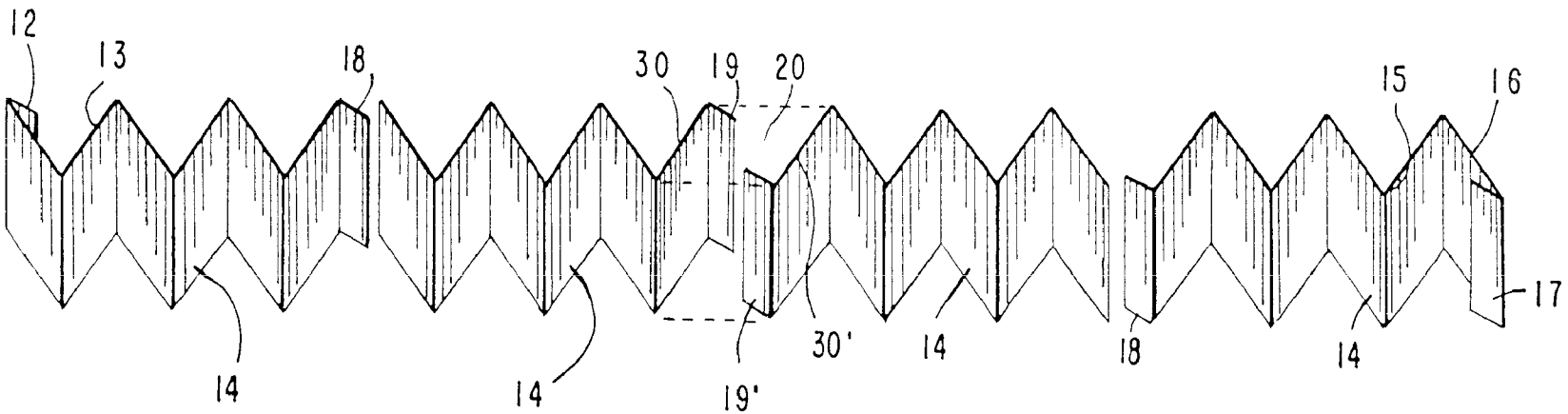
FIG. 5 depicts an embodiment of the accordion folded pages when formed from multiple sheets of material in accordance with the present invention.

Referring to FIG. 5, the accordion folded pages of the book can be made up of multiple sheets of paper and attached by means of a tab 18 which is secured to the next sheet with any suitable adhesive known to one skilled in the art. If the slidable binder which is employed in the construction of the book employs more than two interior elongated sections, then it is preferable to use multiple sheets of paper to make up the accordion pages. When multiple sheets are employed to form the accordion folded pages, an interior pocket 20 can be formed around the optional third 9 interior blade (see FIGS. 3A and 3B). For example the end page 30 of one section may be provided with a tab 19 for connection to fold end of an opposing end page 30' of a second section. Likewise, the end page 30' of the second section maybe provided with a tab 19' for connection to fold end of end page 30 of the first section.

Figure 6C:
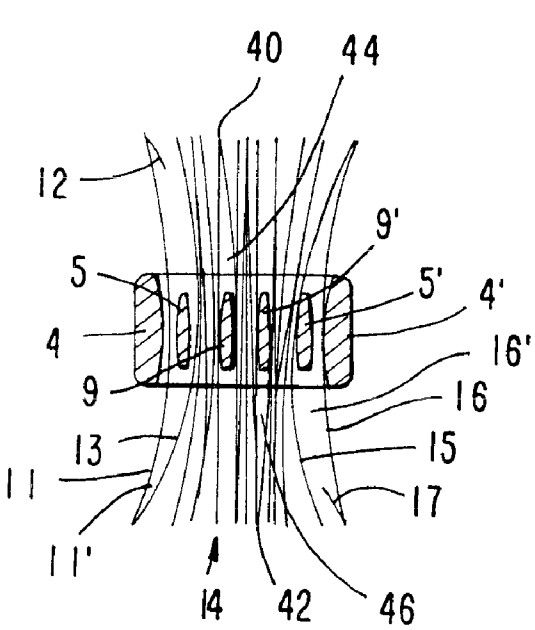
FIGS. 6A, 6B and 6C depict three different embodiments of the mechanics of attaching the accordion folded pages to a book binding in accordance with the present invention.
Figure 6B:
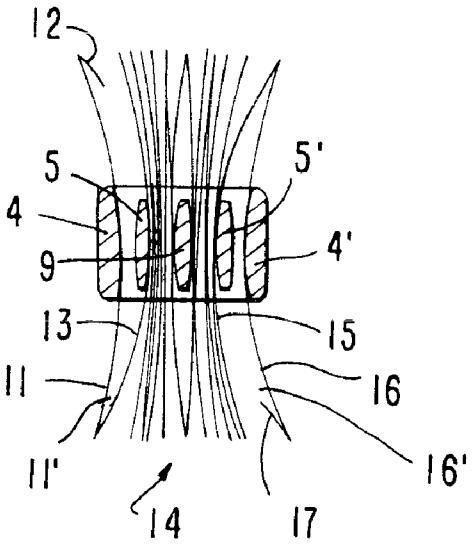
Figure 6A:
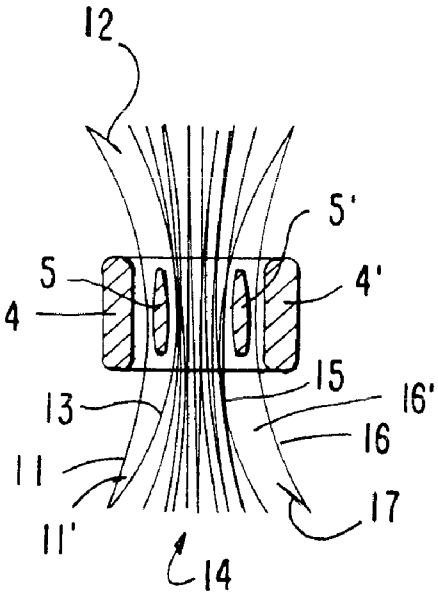

Referring to FIG. 6A the pages of the book are secured to the binding by forming pockets 11' and 16' around blades, 5 and 5', respectively. One end of the accordion pages 11 will be attached to an elongated section of the binding 5 by inserting one end of the page material 11 between the exterior elongated section 4 and the interior elongated section 5' thereby encircling the interior elongated section 5 and affixing the tab 12 to the anchor page 13 with any suitable adhesive known to one skilled in the art. The opposite end of the page material will be attached to interior elongated section 5' by inserting one end of the page material 16 between exterior elongated section 4' and interior elongated section 5' thereby encircling interior elongated section 5' and affixing tab 17 to anchor page 15 with any suitable adhesive known to one skilled in the art. (FIG. 6A) Affixing the tabs to the anchor pages in the described manner, creates an open pocket 11' (FIGS. 6A, 6B and 6C) between the end page 11 and the anchor page 13 and in addition, on the opposite end, an open pocket 16' (FIG. 5) between the end page 16 and the anchor page 15. The pocket is the length of all the interior pages and therefore permits the free slidable movement of the binding necessary to allow full access to the "pages" of each of the two sets of pages.

Referring to FIG. 6B, the pages of the book are secured to the binding at three points, 5, 5' and 9. The two ends of the accordion folded pages are secured to the left interior elongated sections 5 and the right interior section 5' in the same manner as described above with regard to FIG. 6A. The accordion folded pages 14 are also secured to the center elongated section 9 (see FIGS. 3A and 3B). The preferred method for securing the accordion folded pages to the center elongated section 9 requires the accordion folded pages to be constructed from at least two sheets of material as described in FIG. 5. The two sheets of material are joined together around the center elongated section 9 by affixing end tab 19 to end page 30 with any suitable adhesive known to one skilled in the art and affixing end tab 19' to end page 30' with any suitable adhesive known to one skilled in the art, thereby forming a pocket 20 which encircles interior elongated section 9. The pocket is the length of all the interior pages and therefore permits the free slidable movement of the binding necessary to allow full access to the "pages" of each of the two sets of pages.

Referring to FIG. 6C, the binding is provided with four interior elongated sections 5, 9, 9', and 5'. The pages of the book are secured to the binding at two points, 5 and 5'. One end of the accordion pages 11 will be attached to an elongated section of the binding 5 by inserting one end of the page material 11 between the exterior elongated section 4 and the interior elongated section 5 encircling the interior elongated section 5 and affixing the tab 12 to the anchor page 13 with any suitable adhesive known to one skilled in the art. The unattached end of the accordion folded pages shall be woven over the second interior elongated section 9 and under the third interior section 9' and then attached to interior elongated section 5' by inserting one end of page material 16 between the interior elongated sections 5' and exterior elongated section 4' thereby encircling interior elongated section 5' and affixing tab 17 to anchor page 15 with any suitable adhesive known to one skilled in the art. (FIG. 6C) Affixing the tabs to the anchor pages in the described manner, creates an open pocket 11' (FIGS. 6A, 6B and 6C) between the end page 11 and the anchor page 13 and in addition, on the opposite end, an open pocket 16' (FIG. 5) between the end page 16 and the anchor page 15. The pocket is the length of all the interior pages and therefore permits the free movement of the binding necessary to allow full access to the "pages" of each of the two sets of pages.

Additionally, by weaving the interior accordion pages 14 between interior elongated sections 9 and 9', there is provided a fold 40 and a fold 42 which are oppositely positioned around and which operate to form a half pocket 44 interior elongated section 9 and a half pocket 44 around interior elongated section 9', respectively. These two half pockets 42 and 44 also serve to attach the accordion pages 14 to the binding.

Figure 7B:
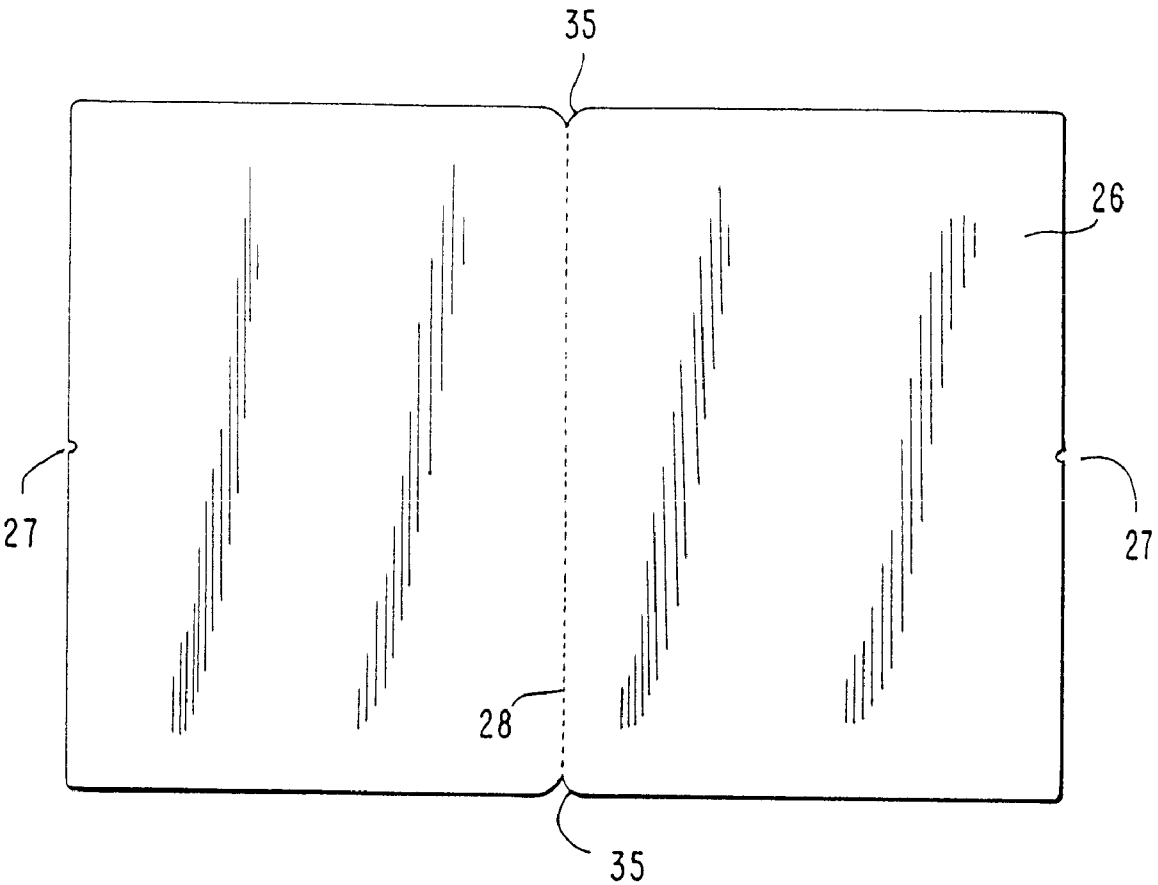
FIG. 7B depicts an embodiment of an art board cover useful in the practice of the present invention.
Figure 7A:
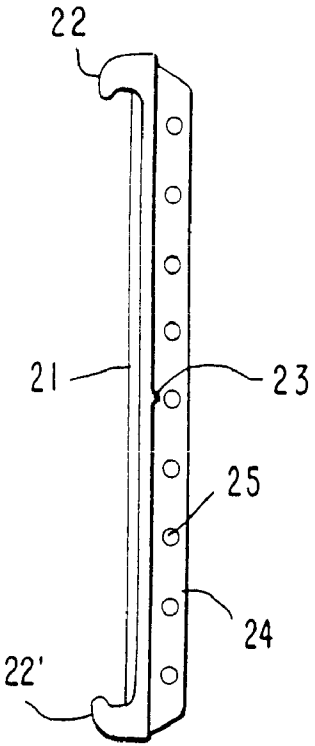
FIG. 7A depicts an embodiment of a hinge insert useful in the practice of the present invention.

Referring to FIG. 7A, there is shown an embodiment of a hinge insert 21 of an optional book cover for use in accordance with the present invention. The hinge insert 21 is constructed of a rigid material and formed to contain a hook shaped protrusion 22 at the top and a hook shaped protrusion 22' at the bottom, both protrusions 22 and 22' extend from the hinge insert on the same plane and the hook shaped protrusions 22 and 22' face each other. On the opposite side of the hinge insert 21 from the hook shaped protrusions 22 and 22', the hinge insert 21 comprises an elongated section 24 which serves as a mounting surface for the paper board cover 26 (front or back) (FIG. 7B). The mounting surface 24 may contain multiple perforations 25. The mounting surface 24 also may be provided with a guide notch 23 for attaching the art board cover 26 to assist in ensuring that the cover is centered on the hinge insert 21.

Referring to FIG. 7B there is shown an embodiment of the art board front or back cover 26. The paper board front or back cover 26 is constructed of a rigid material and formed to contain cut outs 27 in the center of two opposing edges of the paper board cover 26. The cut outs 27 allow for centering the art board cover on the hinge insert 21 by aligning the cut out 27 with the guide 23 on the hinge insert 21. The paper board cover 26 is bifurcated down the center of the cover with a score line 28 running from the top to the bottom of the paper board cover to facilitate folding the art board cover when mounting it on the hinge insert 21. The art board cover can optionally incorporate rounded edges 35 on either side of the perforation so that when the art board cover is folded and mounted on the hinge insert the outside corners will be rounded as shown in FIGS. 8A and 8B.

The paper board cover 26 suitable for use with the present invention may be comprised of a rigid material, such as paper, cardboard, or plastic or a combination thereof The hinged covers are hingeably mounted to the movable binding by means of the tension or snap fit of the shaped protrusions 22 and 22' (FIGS. 7A and 8B) placed into the round depressions 7 in the top connector 3' (FIG. 2C) of the binding 1 and the round depressions 8 in the bottom connector 6' (FIG. 2G) of the binding 1. Of course other types of hinge constructions known to those of ordinary skill in the art may be employed.

Figure 8A:
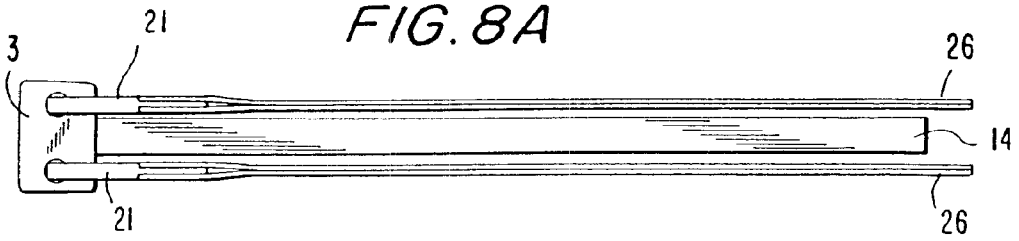
FIGS. 8A and 8B depict an embodiment of a book cover useful in the practice of the present invention.
Figure 8B:
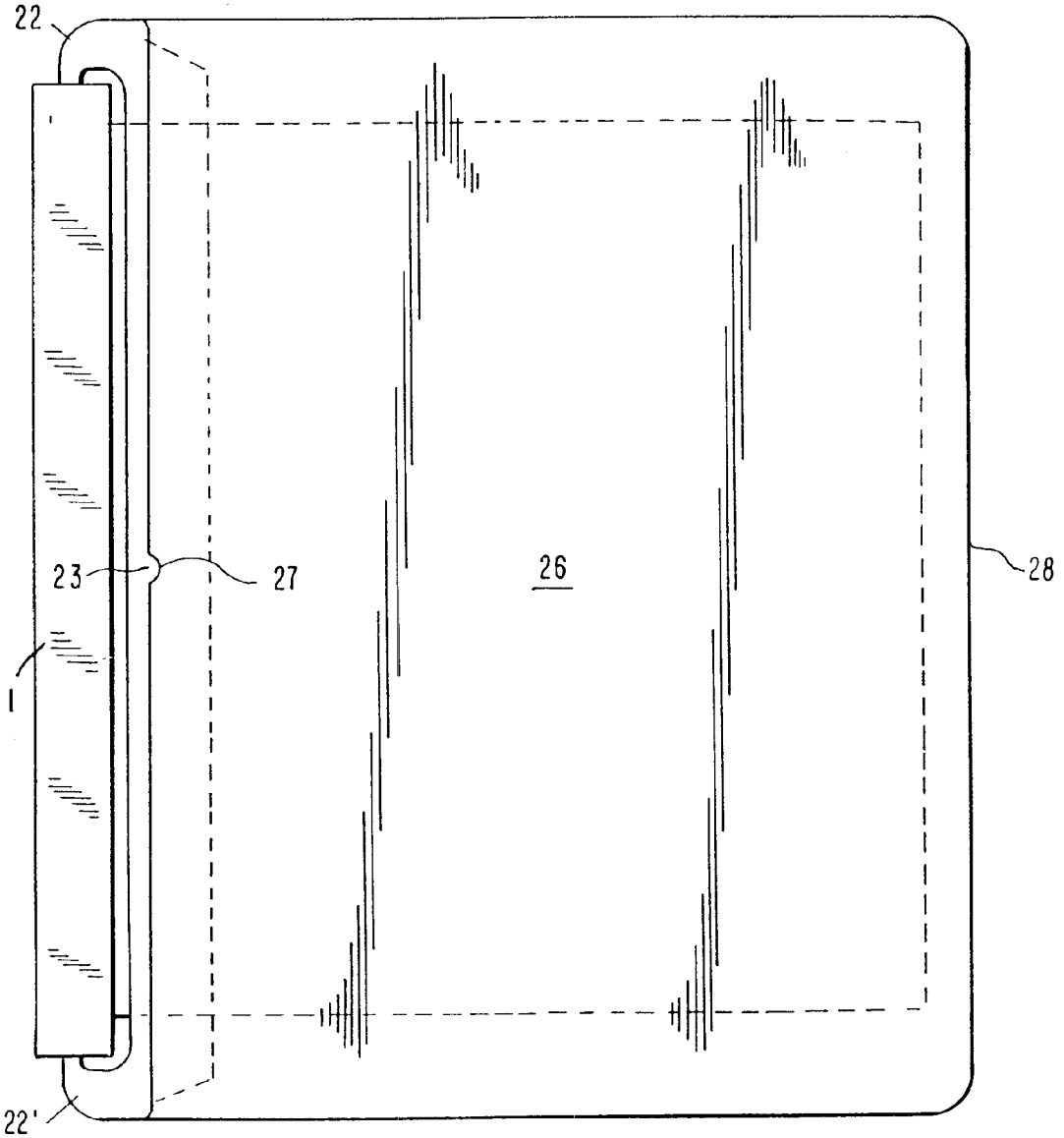
Figure 9A:
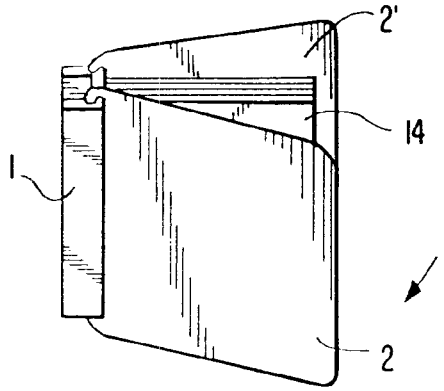
FIGS. 9A, 9B, 9C and 9D depict the manner in which a book of the present invention is operated.
Figure 9B:
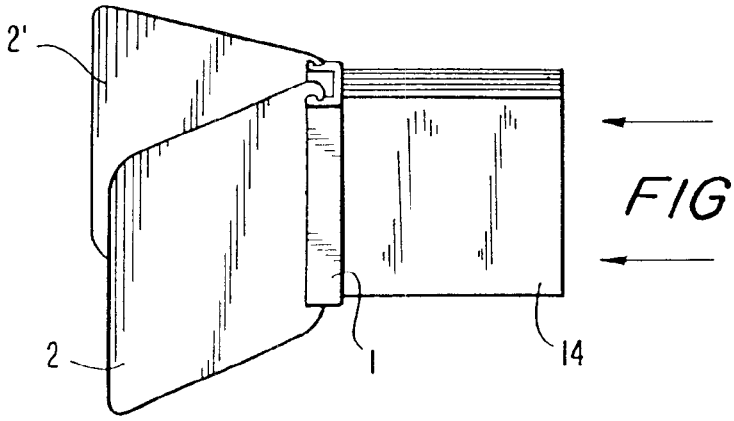
Figure 9C:
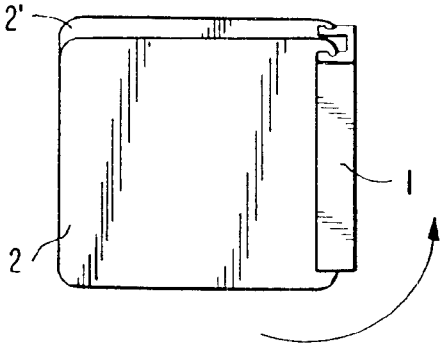
Figure 9D:
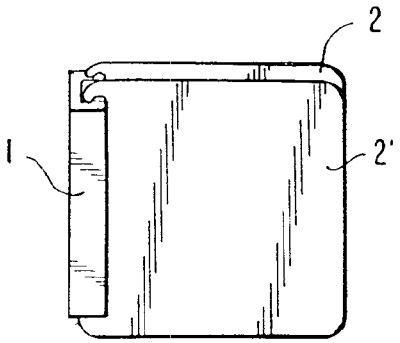

FIG. 8A shows a top view of an embodiment of the present invention incorporating the optional hinged covers and FIG. 8B shows a side view of an embodiment of the current invention incorporating the optional hinged covers. Each hinged cover is composed of a formed hinged insert 21 and a paper board cover 26.

Referring to FIGS. 9A thru 9D, inclusive, these figures demonstrate the progression of steps to transform an embodiment of the invention, with the optional covers, from a book which opens to expose one side of the pages to a book which opens to expose the other sides of the pages.

Various modifications to the above invention will become apparent to those skilled in the art, all of which are intended to fall within the spirit and scope of the present claimed invention. All patents and publications referred to herein are hereby incorporated by reference.

I claim:

1. A reading device comprising:

(a) a set of accordion-folded pages; and (b) a binding comprising at least four elongated sections each said elongated section constructed of a rigid material and set parallel to each other with at least two interior sections and two exterior sections, connected at the top by a top connector constructed of a rigid material capable of maintaining a set distance between each said elongated section, and connected at the bottom by a bottom connector constructed of a rigid material capable of maintaining a set distance between each elongated section; and (c) wherein said accordion folded pages are slidably affixed at least at two points, one end to one of the interior elongated sections and at the opposite end to the other interior elongated section, so that the interior pages of the accordion folded pages are compressed between the two interior elongated sections of said binding;

whereby sliding the binding and flipping the book over enables the user to have access to the opposite sides of said pages.

2. A reading device as defined in claim 1, wherein said device is a book.

3. A reading device as defined in claim 1, wherein said device is a greeting card or a brochure.

4. A reading device as defined in claim 1, which further comprises a front cover and a back cover hingeably mounted on the binding.

5. A reading device as defined in claim 4 wherein said front and back covers are comprised of a cover sheet and a hinge insert, wherein said cover sheet is folded along its center and the opposing edges thereof are attached to said hinge insert.

6. A reading device as defined is claim 4 wherein said hinge insert comprises a mounting surface along one edge and hook shaped protrusions at the top and bottom of said hinge insert, said hook shaped protrusions extending away from the edge provided with said mounting surface and adapted for hingeably attaching to said reading device binding, and wherein said opposing edges of said cover sheet are mounted on the top and bottom of the mounting surface of said hinge insert.

7. A reading device as defined in claim 4 wherein said hinge insert is provided with one or more placement guides and the opposing edges of said cover sheet is provided with corresponding cutouts to ensure proper alignment of said cover sheet onto said hinge insert.

8. A reading device as defined in claim 4 wherein said center of said cover sheet is provided with a score line for facilitating folding.

9. A reading device as defined in claim 5 wherein said hinged insert is constructed of a rigid material selected from a group consisting of paper, cardboard, laminated paper, laminated cardboard, foam rubber or plastic or a combination thereof.

10. A reading device as defined in claim 5 in wherein said art board cover is constructed of a rigid material selected from a group consisting of paper, cardboard, laminated paper, laminated cardboard, foam rubber or plastic or a combination thereof.

11. A reading device as defined in claim 6, wherein said binding further comprises a hinge stop in the top and/or bottom connectors.

12. A reading device as defined in claim 4, wherein said front cover is constructed of a rigid material selected from a group consisting of paper, cardboard, laminated paper, laminated cardboard, foam rubber or plastic or a combination thereof.

13. A reading device as defined in claim 4 wherein said back cover is constructed of a rigid material selected from a group consisting of paper, cardboard, laminated paper, laminated cardboard, foam rubber or plastic or a combination thereof.

14. A reading device as defined in claim 1 wherein said set of accordion-folded pages are constructed of a material selected from a group consisting of paper, cardboard, laminated paper, laminated cardboard, foam rubber or plastic.

15. A reading device as defined in claim 1 wherein said set of accordion-folded pages are imprinted on both sides with complementary material including text and/or graphics.

16. A reading device as defined in claim 1 wherein said set of accordion-folded pages are imprinted on both sides with material of independent interest including text and/or graphics.

17. A reading device as defined in claim 1 wherein said set of accordion-folded pages are imprinted on both sides with dependent material including text and/or graphics.

18. A reading device as defined in claim 1 wherein said binding is constructed of a material selected from a group consisting of wood, metal or plastic.

19. A reading device as defined in claim 15 wherein said complementary material comprises the alphabet printed on the first side and words beginning with each corresponding letter of the alphabet on the second side.

20. A reading device as defined in claim 16 wherein said independent interest material comprises the alphabet printed on the first side and numbers printed on the second side.

21. A reading device as defined in claim 17 wherein said dependent material comprises questions on the first side and the corresponding answers on the second side.

* * * * *